United States Patent [19]

Larrimore

[11] 3,949,212

[45] Apr. 6, 1976

[54] UNDERWATER LIGHTING FOR DEFENSE AGAINST SWIMMER ATTACK

[75] Inventor: Herbert Larrimore, Lynn Haven, Fla.

[73] Assignee: The United States of America as represented by the Secretary of the Navy, Washington, D.C.

[22] Filed: Nov. 10, 1969

[21] Appl. No.: 870,557

[52] U.S. Cl. ..... 240/26; 114/240 R

[51] Int. Cl.[2] ..... F21V 31/00

[58] Field of Search ..... 240/26; 114/240, 66

[56] References Cited

UNITED STATES PATENTS

| | | | |
|---|---|---|---|
| 1,921,230 | 8/1933 | Hunter | 240/26 |
| 2,779,866 | 1/1957 | Burlingham | 240/26 |
| 3,180,980 | 4/1965 | Morrison | 240/26 |
| 3,456,103 | 7/1969 | Bond | 240/26 |
| 3,474,243 | 10/1969 | Miller | 240/26 |

FOREIGN PATENTS OR APPLICATIONS

| | | | |
|---|---|---|---|
| 21,723 | 10/1907 | United Kingdom | 240/26 |

*Primary Examiner*—Samuel Feinberg
*Attorney, Agent, or Firm*—Richard S. Sciascia; Don D. Doty; William T. Skeer

[57] ABSTRACT

An underwater light unit is constructed to be placed together within similar units around a ship anchorage on the bottom of a body of water. The construction of the optical portion of the housing permits the uniform illumination of said bottom with a high intensity light so as to produce good silhouette in the volume of water space located above the light units, as well as permitting direct observation of objects on said bottom. The optical portion and base portions interfit in such a manner as to have their watertight integrity remain uneffected by nearby explosions. The housing and mounting stake are constructed and arranged so as to provide a low mounting height above the bottom, so as not to interfere with the passage of surface vessels through the illuminated water space. A power distribution circuit connects each of the lighting units individually to a power source to permit individual service of the several units without interrupting the power flow to the remaining units or exposing the servicing personnel to unnecessary shock hazard.

8 Claims, 5 Drawing Figures

Herbert Larrimore
INVENTOR.
BY William T. Skeer
Agent
Dee D. Oster
Attorney

Herbert Larrimore
INVENTOR.

BY William T. Skuer
Agent

Don D. Doty
Attorney

Herbert Larrimore
INVENTOR.

BY William T. Skeer
Agent

Don D. Doty
Attorney

UNDERWATER LIGHTING FOR DEFENSE AGAINST SWIMMER ATTACK

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

This invention relates to a port security system, and more particularly, but not by way of limitation, this invention relates to an apparatus and method to detect the presence of enemy swimmers in the waters surrounding docks, piers, breakwaters, bridges, or other harbor or estuarial architecture. In greater particularity, the invention relates to an apparatus and method to discover the presence of enemy swimmers as a step in countering the placement of marine mines at ship anchorages.

The protection of merchant and naval ships against enemy action is, of course, an object of all naval powers. As grevious as the loss of a ship is to such naval powers, it is even more lamentable if the loss occurs in a harbor anchorage or at dock side, for an immobile sunk ship prevents the further use of the dock or anchorage for the intended purpose. It is for this reason that a ship at anchor or tied alongside a dock, as it is unloaded or loaded, is in particular peril of enemy attack.

Prior art attempts to prevent such enemy action have for the most part involved apparatus to secure the anchorage from underwater approach. Such devices have included a variety of barriers, fences, nets, and other restrictive devices. While these devices prevent swimmers from approaching the anchorage, they also interfere with the normal movement of the ships using the anchorage. Further, the restrictive devices may be breached without detection.

BRIEF SUMMARY OF THE INVENTION

This invention provides for the protection of naval and merchant ships by providing an improved anchorage arrangement where the approach of swimmers carrying ordnance may be easily detected. This improved anchorage is characterized as having an illuminated periphery about the dock structure and the berthing space alongside thereof.

The aforementioned illuminated periphery is obtained by the novel underwater electrical fixture of this invention. This fixture is particularly adapted to its intended purpose by virtue of its unique construction and combination with a new light source. The particular environmental hazards which have previously limited such light fixture placement and which have been overcome by this fixture are the destructive shock waves produced by the anti-swimmer ordnance and the local strong water currents produced around the docking or departing ship. These strong currents are occasioned by the action of the docking vessel's screws and the displacement currents associated with the ship's movement.

The repair of individual ones of the light fixtures without disturbing the operation of the remaining units is made possible by a new power distribution system disclosed herein.

Accordingly, it is an object of this invention to provide a new, improved ship docking facility.

A further object of this invention is the provision of a swimmer detection apparatus and method which makes possible the visual detection of swimmers approaching a predetermined area.

Another object of this invention is the provision of an improved underwater lighting fixture.

A further object of this invention is the provision of an underwater lighting fixture which is particularly resistive to damage by underwater shock waves.

Yet another object of this invention is an improved underwater lighting fixture with low water resistance to water currents flowing thereabout.

Another object of this invention is the provision of an underwater swimmer detection system which deters a swimmer from approaching a structure protected thereby.

A further object of this invention is the provision of an underwater lighting system which causes a disorientation of swimmers passing through the volume of water illuminated thereby.

A further object of this invention is the provision of an underwater illumination system employing a plurality of individual lighting fixtures and a power distribution system therefor, permitting individual units to be extinguished for repair or relocation without interrupting the electrical power to other units comprising the system.

A still further object of this invention is the provision of an improved shipdocking facility with a peripheral lighting system extending beyond the ship berth and a power distribution system located on said ship docking facility.

Other objects and many of the attendant advantages will be readily appreciated as the subject invention becomes better understood by reference to the following detailed description, when considered in conjunction with the accompanying drawings.

DESCRIPTION OF THE PREFERRED EMBODIMENT

Figure 1:
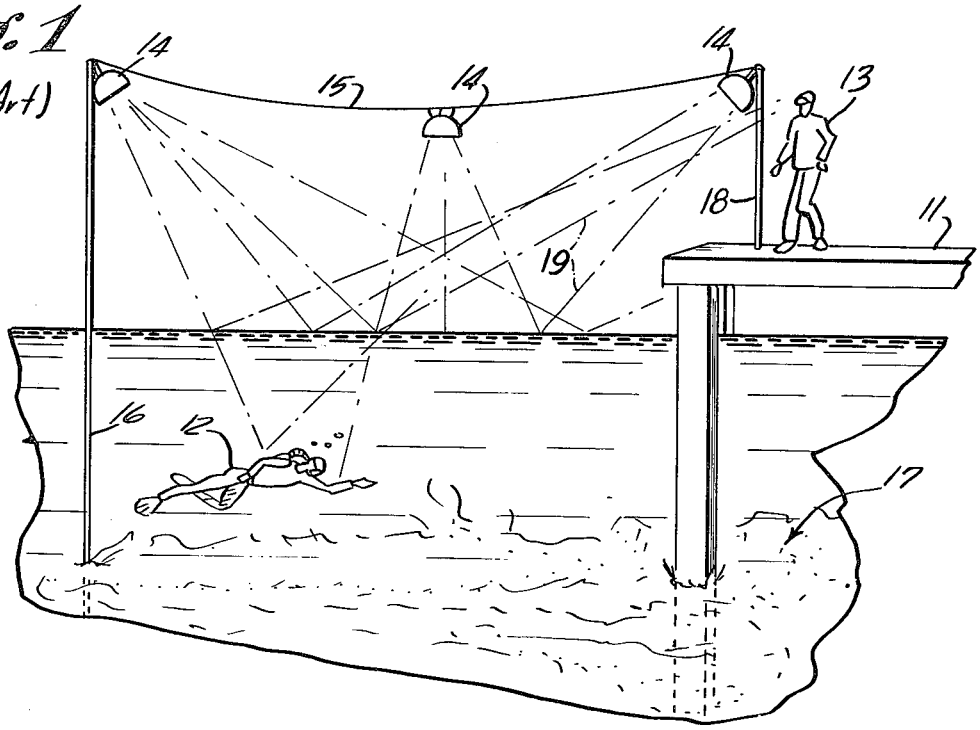
Fig. 1 (Prior Art)
FIG. 1 is a sectional view of a prior art type docking facility employing an illumination system for swimmer detection.

Referring to FIG. 1, a dock 11 is shown being approached by a swimmer 12. If swimmer 12 can reach the anchorage space alongside dock 11 on the peristyle thereunder, he may plant a mine which could sink vessels using dock 11 at dockside. To prevent this action, a watch 13 is posted on dock 11 to detect swimmer 12 and take countermeasure action thereagainst. The most effective countermeasure thusfar devised in the use of small concussion producing explosive charges. These charges are of sufficient strength to render a nearby swimmer 12 unconscious but not of such strength to damage the dock 11.

Detection of swimmer 12 by watch 13 is simple task of direct observation which has proven satisfactory in clear water and under favorable illumination. However, in harbor waters which are murky and after nightfall, artificial illumination is required for detection. The most satisfactory arrangement used prior to the present invention consists of suspending a plurality of lighting fixtures 14 above the surface of the water, as shown in FIG. 1. These fixtures 14 are supported from a line 15, which may comprise the electrical conductors supplying power to the light sources in fixtures 14. Line 15 is supported at its remote end by an upright 16 mounted a suitable distance from dock 11 in the bottom 17. A similar upright 18 supports the other end of line 15 and is mounted on dock 11. Uprights 16 and 18 are of sufficient length to support fixtures 14 at the desired height above the water surface.

The precise height at which fixtures 14 are suspended above the water depends upon the area of dock 11 being protected and the manner in which the units are to be employed. That is, if the light fixtures are to be used while a ship is tied alongside a dock, the height must be great enough to clear the superstructure of the ship. For ocean going vessels, this height is impractical and fixtures 14 and line 15 must be strung between a plurality of freestanding uprights 16 or from the ship's rigging to upright 16.

Prior art arrangements, as shown in FIG. 1, suffer from surface glare as shown by light rays 19 reflecting from the surface of the water. The ripple and small waves always present in such waters cause highlight and shadow patterns to shift about and obscure the light reflected from swimmer 12. Too, the water spouts from the explosive charges thrown by watch 13 frequently contact the hot light source or glass optics within fixture 14 with resulting breakage.

Figure 2:
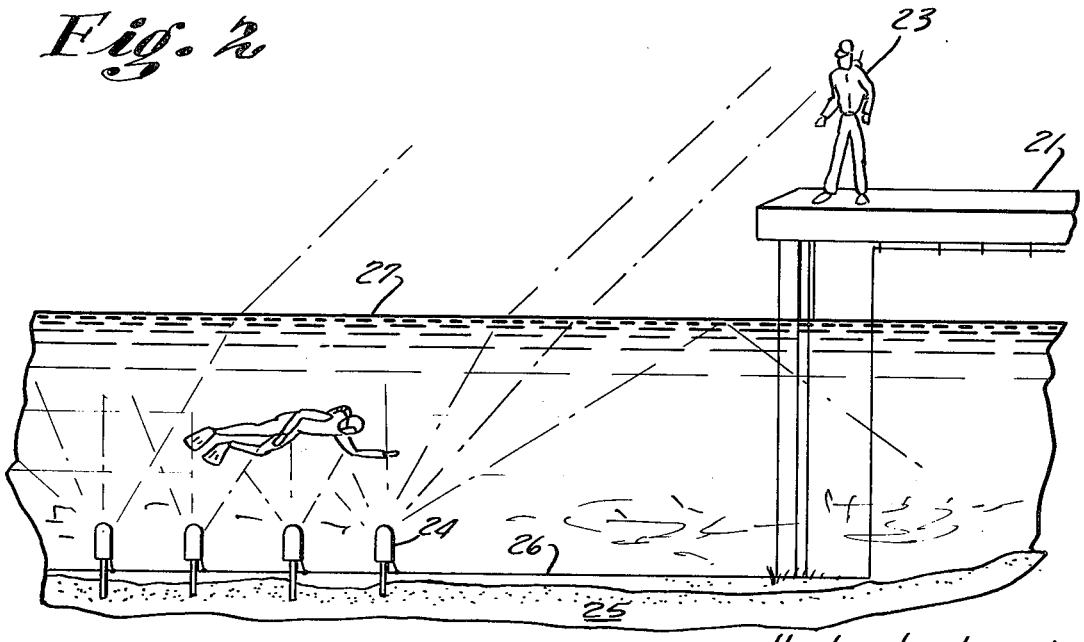
FIG. 2 is a sectional view of the docking facility according to the invention.

Referring to FIG. 2, the improved system according to the invention will be explained. An estuarial or riverine structure, such as dock 21, is shown being approached by an underwater swimmer 22. A watch 23 is shown posted on dock 21 to detect the approach of swimmer 22 and to initiate countermeasures thereagainst. A plurality of lighting fixtures 24 are placed on the bottom 25 and are individually connected to a power distribution system on dock 21 via a power line 26.

Lighting fixtures 24 illuminate the volume of water above the area of bottom 25 on which they are placed. The water surface presents a more uniform brightness when illuminated from below by light fixtures 24 than when illuminated from above, as by light fixtures 14. The shadow of swimmer 22 shows a marked contrast on this lighted surface, even in the presence of surface irregularities, and permits watch 23 to take effective countermeasure action.

An unexpected advantageous result of using the system of the invention shown in FIG. 2 is a deterrent effect. One would expect the perimeter of strong high contrast light to aid swimmer 22 approaching the protected structure, but, for some unexplained reason, the reverse is true. Swimmers approaching the perimeter of light have difficulty in navigating in the area of bright illumination and have been observed to meander about in the illuminated area and, on some occasions, even surface. These disorientations have occurred even in evaluation tests where the swimmer is free from the distracting pressures associated with the actual operating conditions in which espionage personnel perform their duties. As mentioned previously, the exact reasons for this effect are not completely understood, but it is a very useful advantage of the system which has come to be recognized.

Figure 3:
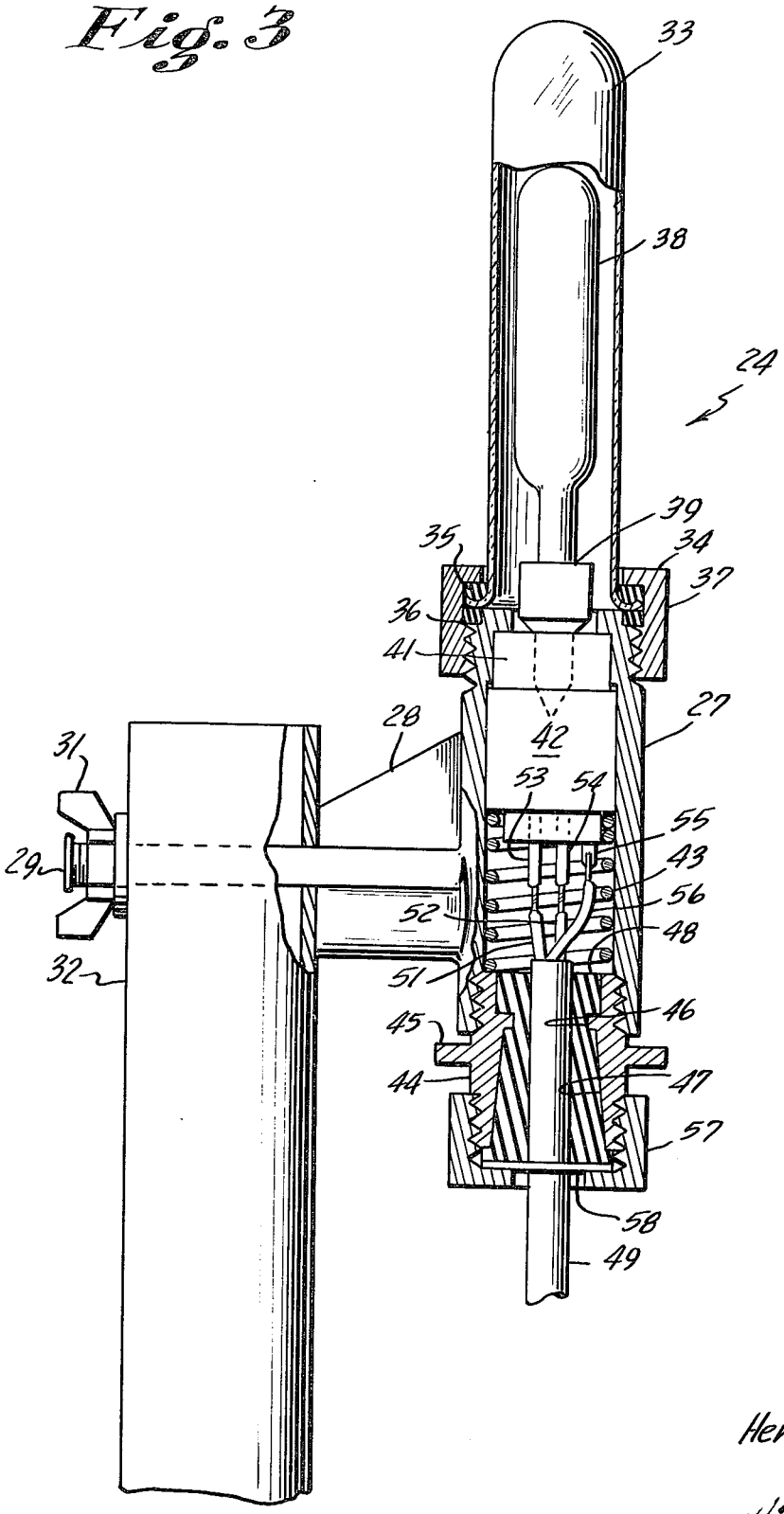
FIG. 3 is a partial sectional view of a lighting fixture according to the invention.

Referring to FIG. 3, there is shown the improved lighting fixture 24 used in the practice of Applicant's invention. Fixture 24 comprises a tubular body portion 27 which has a bracket 28 extending therefrom. A threaded stud 29 cooperates with a wing nut 31 to secure bracket 28 to a tubular support 32 in an axially parallel but laterally spaced relation. Support 32 is sunk into the bottom to a depth necessary to place bracket 28 approximately 30 to 40 centimeters from the bottom prior to the attachment of bracket 28 thereto.

A transparent cover 33 made of low expansion, heat resistant glass is secured to the upper end of body portion 27 by a threaded gland 34. As shown, cover 33 is of generally cylindrical shape with a hemispherical upper end. The upper surface of body 27 is externally threaded to receive gland 34. Tighting gland 34 onto body portion 27 compresses seals 35 and 36 about an outwardly extending lip 37 on cover 33 to form a watertight joint therewith. Cover 33, when properly seated and retained by gland 34, provides a watertight enclosure for an electro-optical transducer, such as lamp 38.

Lamp 38 is of the iodine quartz type, a variety well known in the illumination arts for producing a high illumination intensity in relation to the electrical power consumed. As shown, lamp 38 is supported by a threaded base 39. The quartz envelope is of clear, unfigured construction to transmit the high intensity light produced by lamp 38 without distortion or absorption. A variety of lamps of the type preferred are made by the various manufacturers in suitable sizes, but the 500 watt 120 volt size which produces 10,000 lumins has proven particularly satisfactory.

A socket assembly comprising an upper socket 41 and a lower socket 42 is positioned at the upper end of body portion 27. Upper socket 41 may be cemented in place, if desired. The threaded portion of the base 39 is received in complementary threads in upper base 41. The lower socket 42 is biased upward by a spring 43 to engage the end portion of base 39. The socket assembly, including upper socket 41 and lower socket 42, may be of any suitable type commercially available. The unit manufactured by the Sylvania Electric Corp. under the tradename "Mini-Can S4" has proven satisfactory.

The lower portion of body portion 27 is internally threaded to receive plug member 44. A flange 45 extends outwardly from plug member 44 and is externally configured to facilitate tool engagement therewith to assist in threading plug member 44 within body portion 27. Plug member 44 has a longitudinally extending bore therethrough which has an internally extending circumferential shoulder 46 and tapered internal walls 47. An apertured seal 48 closes the bore of plug 44 and circumferentially surrounds an insulated conductor 49 passing through the aperture thereof into the internal portions of body portion 27.

Lighting fixture 24 together with support 32 offer a very low resistance to fluid flow in the water surrounding the unit. The streamlined external shape of the fixture 24 is, of course, largely responsible for this low resistance to water flow. The streamlining thereof permits the array of lighting fixtures 24 to be relatively uneffected by the water currents caused by docking and departing ships. The immunity of the array of fixtures from being displaced by water currents promotes the maximum utilization of the device being protected by the system of the invention, with a minimum of down time to maintain the lighting system.

Conductor 49 is of the three wire variety and has a waterproof outer layer. Wires 51 and 52, two of the wires of conductor 49, carry AC power to terminals 53 and 54 protruding from the lower socket 42. A ground lug 55, which is electrically connected to the body portion 27 via the socket assembly, is connected to the third wire 56 of conductor 49. The aperture in seal 48 fits conductor 49 snugly but not so tightly as to interfere with the tightening of plug 44 into body portion 27.

A gland 57 is threaded upon the lower end of plug 44 and carries a pressure washer 58 therewith. Tightening of gland 57 forces pressure washer 58 to compress seal 48 against the internal shoulder 46 and tapered internal walls 47 of plug 44. This compression of seal 48 creates a watertight seal about conductor 49 and prevents water from entering body portion 27.

Figure 4:
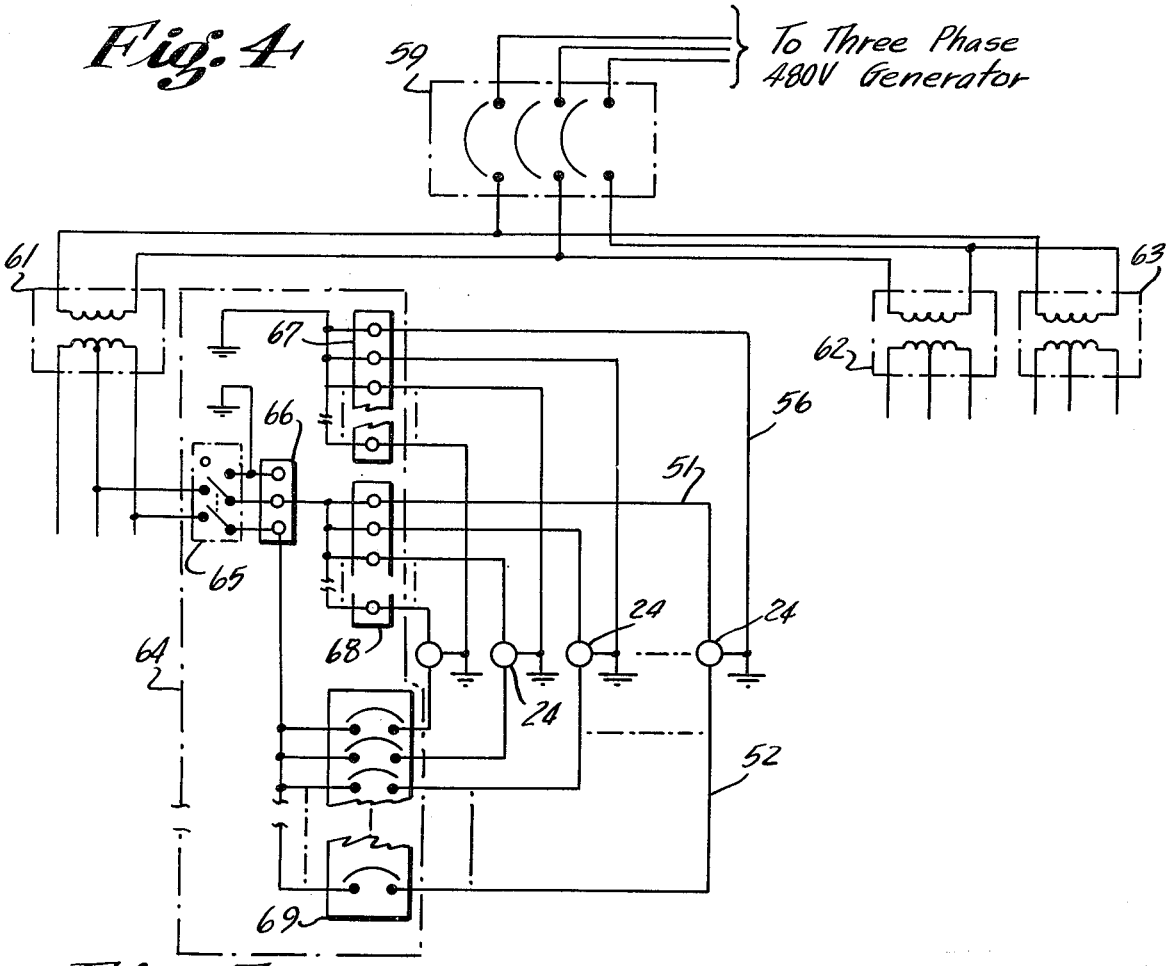
FIG. 4 is a schematic diagram of the power distribution system.

Referring now to FIG. 4, the power distribution system used with the invention is illustrated. The electrical output of a three phase generator is fed, via circuit breaker 59, to transformers 61, 62, and 63. Each of the three transformers supplies electrical current to a plurality of power distribution panels 64, only one of which is shown in FIG. 4 for purposes of simplicity.

Each power distribution panel has a switch 65 which is grounded to the case and earth. The power from switch 65 is fed to a terminal strip 66 which serves as a central distribution point in each distribution panel. An entry terminal strip 67 provides a ground connection for each of the wires 56 connecting the grounding lug 55 of each lighting fixture 24 to ground. Again, it should be noted, that FIG. 4 shows only one set of lighting fixtures, but the other fixtures illustrated schematically are identically wired. A terminal strip 68 provides power connection to each of the lighting fixtures 24 by connecting each wire 51 therefrom to one terminal of centeral distribution terminal strip 66. A circuit breaker strip 69 provides connecting points between the remaining wires 52 and the centeral distribution terminal strip 66. Circuit breaker strip 69 also provides individual switching and electrical overload protection for each lighting fixture 24. Power distribution panels 64 are arranged in conventional fashion so that switch 65 and the individual circuit breaker trips may be operated by personnel without exposing the internal wiring.

MODE OF OPERATION

Figure 5:
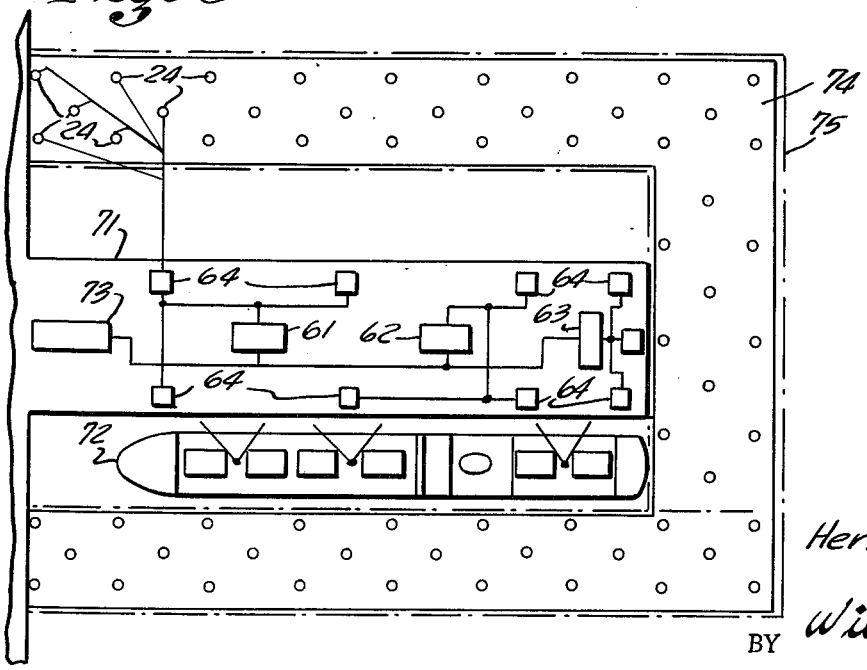
FIG. 5 is a plan view of a ship docking facility according to the invention, showing a hypothetical arrangement of lighting fixtures and power distribution components.

The foregoing description of the lighting fixtures and wiring thereof are clearly sufficient to enable one versed in the electrical lighting arts to make and use the invention. However, to ensure that such a skilled practitioner obtains the maximum benefits therefrom, the devices and circuit of the invention should be utilized in the manner to now be explained with reference to FIG. 5.

A power generator 73 is placed at a convenient location on dock 71 to supply a source of 480 volt, three phase, 60 cycle alternating current. The advantage of close placement of generator 73, preferably on dock 71, is that the source of energization potential is within the security compound of the dock watch and therefore less susceptible to espionage damage than if outside power sources were used to energize light fixtures 24. In areas where there is no danger of power interruption due to espionage, shore power may be employed.

As suitable locations along dock 71, transformers 61, 62 and 63 are located. The particular locations are not critical to the operation of the system, but the orderly movement of goods and personnel on the dock may be facilitated if the high voltage lines and transformer placement are out of the way of dock traffic. In this regard, it should be noted that the illustrated sizes and relative placement of the electrical equipment are not to scale and are schematic represenations only. Power distribution panels 64 are placed at convenient locations about the dock periphery where conductors 49 may conveniently be routed into the water.

Supports 32 are next placed in the positions desired on the bottom. The supports 32 are sunk about one meter in the bottom by either driving or jetting. The latter is a process in which water is forced through the hollow center of support 32 to displace the bottom material which deposits back around support 32 to hold it in place. The exact spacing of supports 32 is dependent on a number of considerations including the reflectivity of the bottom, the opacity of the water, and the desired illumination level. To ensure detection, it has been found advantageous to space the fixtures and select a wattage to make a swimmer on the bottom visible to the surface watch by reflected light. In locations having bottoms of low reflectivity and where sedimentation is not a major factor the system may employ a reflective bottom cover 74 in the zone of illumination 75, which is shown bounded by broken lines in FIG. 5. Bottom cover may be made of a plastic sheet material or may simply be a layer of light colored shells or sand spread on the bottom. It should be noted that the zone of illumination 75 does not extend up to the edge of the dock 71 on all sides, but leaves a berthing space for ship 72 alongside the dock. In cases where the protected structure is not a dock, the zone of illumination 74 may, of course, extend up to the structure.

Light fixtures 24 are mounted to supports 32 and wing nut 31 tightened to secure the fixtures in place. Conductors 49 are routed along the bottom, secured in place, and connected to power distribution panels 64.

When the system is energized a bright zone of illuminated water surrounds dock 71. A watch posted on dock 71 and ship 72 moored alongside thereof observes the illuminated surface of the water and, when a darkened shadow passes thereacross, throws a concussion grenade into the water above the shadow to disable the swimmer. As previously noted, if the swimmer tries to make his way through the illuminated zone on the bottom, the illumination level is high enough to reveal his presence by reflected illumination rather than silhouette obstruction of the light.

The foregoing description taken together with the appended claims constitute a disclosure such as to enable a person skilled in the illumination and marine engineering arts and having the benefit of the teachings contained therein to make and use the invention. Further, the structure described meets the objects of invention, and generally constitutes a meritorious advance in the art unobvious to such an artisan not having the benefit of the teaching contained herein.

Obviously, other embodiments and modifications of the subject invention will readily come to the mind of one skilled in the art having the benefit of the teachings presented in the foregoing description and the drawings. It is, therefore, to be understood that this invention is not to be limited thereto and that said modifications and embodiments are intended to be included within the scope of the appended claims.

What is claimed is:

1. A swimmer detection and deterrent system for use in combination with architecture extending into a body of water and supported on the bottom thereof for preventing undetected approach to said architecture by a swimmer beneath the surface of said body of water comprising in combination:

a plurality of tubular support means positioned about said architecture in a predetermined pattern and penetrating vertically into said bottom so as to extend upwardly into said body of water a predetermined distance;

a plurality of body portion means having tubular shapes for providing an enclosed centeral region therewithin;

bracket means extending outwardly at right angles from said body portion means and releasably attached to individual ones of said tubular support means, so as to vertically mount a tubular body portion means on each of said tubular support means;

transparent cover means mounted on and extending upwardly from the upper end of each of said body means and having cylindrically shaped wall portions with the remote end thereof closed by a hemispherically shaped end portion and having the end adjoining said body portion means characterized by an outwardly extending lip means for establishing a mounting surface therefor;

first anular resilient seal means located between the end of said body portion means and said outwardly extending lip means of said transparent cover means for providing a resilient watertight seal therebetween;

first gland means threadably mounted on said body portion means and having an aperture through which the aforementioned hemispherical end portion and the cylindrical wall portions of said transparent cover means extend, with the edges of said aperture engaging said lip means of said transparent cover means to retain said transparent cover means on said body portion means;

second anular resilient seal means located between said gland means and said lip means to provide yielding contact between the aforesaid edges of said aperture and said lip means;

electro-optical transducer means for converting electrical energy supplied thereto into radiant energy in the visible spectrum which radiates therefrom;

upper socket means mounted at the upper end of said body portion means within said enclosed centeral region for supporting said electro-optical transducer means within said transparent cover means;

lower socket means having electrical terminals for engaging the lower portion of said electro-optical transducer in cooperation with said upper socket means;

plug means threadably mounted on the lower end of said body portion means and having an aperture with sloping converging surfaces for closing the lower end of said body portion;

spring means located between said plug means and said lower socket means for urging said lower socket away from said plug means and into contact with the electro-optical transducer means;

electrical conductor means connected to said electrical terminals of said lower socket means and extending through said aperture in said plug means for transmitting electrical power to said electro-optical transducer means;

flange means integrally connected to said plug means and extending outwardly therefrom for providing tool engaging surfaces for facilitating assembly of said plug means and said body portion means;

apertured seal means fitting said aperture within said plug means and surrounding said electrical conductor means for providing a watertight seal therebetween; and second gland means threadably mounted on said plug means for compressing said apertured seal means in order to improve the water tightness of the fit thereof.

2. A swimmer detection and deterrent system according to claim 1 in which the predetermined pattern of said support means delimits an undisturbed area adjacent said architecture in which no supports are placed.

3. A swimmer detection and deterrent system according to claim 1 in which the body portion means is supported in a position axially parallel to, but laterally spaced from, said support means.

4. A swimmer detector and deterrent system according to claim 1 in which said transparent cover means is made of a heat resistant low expansion glass.

5. A swimmer detection and deterrent system according to claim 1 in which said electro-optical transducers means comprises an iodine quartz lamp.

6. A swimmer detection and deterrent system according to claim 1 further comprising electrical power source means located on said architecture and comprising a plurality of electrical transformer means electrically connected to said electrical conductor means for supply of electrical current thereto.

7. A swimmer detection and deterrent system according to claim 6 in which said electrical power source comprises electrical current interruption means.

8. A swimmer detection system according to claim 1 further comprising:

light reflecting means located on the bottom of said body of water and covering said bottom in the area of said predetermined pattern in which said support means are positioned for reflecting light upwardly therefrom, thereby increasing the intensity of said radiant energy in the volume of water thereabove.

* * * * *